US008727344B2

(12) United States Patent
De Ambrogio et al.

(10) Patent No.: US 8,727,344 B2
(45) Date of Patent: May 20, 2014

(54) SYSTEM FOR IMPROVING STACKING OF FLAT ITEMS

(71) Applicant: Neopost Technologies, Bagneux (FR)

(72) Inventors: Attilio De Ambrogio, Cigliano (IT); Daniele Piano, Quagliuzzo (IT)

(73) Assignee: Neopost Technologies, Bagneux (FR)

( * ) Notice: Subject to any disclaimer, the term of this patent is extended or adjusted under 35 U.S.C. 154(b) by 0 days.

(21) Appl. No.: 13/725,043

(22) Filed: Dec. 21, 2012

(65) Prior Publication Data

US 2013/0161155 A1 Jun. 27, 2013

(30) Foreign Application Priority Data

Dec. 23, 2011 (EP) ..... 11306769

(51) Int. Cl.
*B65H 31/00* (2006.01)

(52) U.S. Cl.
USPC ..... 271/180; 271/177; 271/213

(58) Field of Classification Search
USPC ..... 271/31.1, 177, 180, 181, 201, 213, 214; 198/697; 414/798.4, 798.5, 798.6, 414/798.7
See application file for complete search history.

(56) References Cited

U.S. PATENT DOCUMENTS

| | | | | |
|---|---|---|---|---|
| 3,865,365 | A * | 2/1975 | Hardin et al. | 271/214 |
| 4,518,160 | A * | 5/1985 | Lambrechts et al. | 271/214 |
| 4,595,188 | A * | 6/1986 | Wiley et al. | 271/4.01 |
| 4,903,955 | A * | 2/1990 | Manzke | 271/176 |
| 5,221,080 | A * | 6/1993 | Ricciardi | 271/214 |
| 5,524,876 | A | 6/1996 | Porter | |
| 6,634,639 | B2 * | 10/2003 | Kuroda et al. | 271/178 |
| 6,959,923 | B2 | 11/2005 | Leitz et al. | |
| 7,344,134 | B1 * | 3/2008 | Keane et al. | 271/178 |
| 8,002,263 | B2 * | 8/2011 | Meintker et al. | 271/12 |
| 2002/0017447 | A1 | 2/2002 | Emigh et al. | |
| 2003/0079626 | A1 | 5/2003 | Yoshitani | |
| 2009/0242464 | A1 | 10/2009 | Stubleski et al. | |

FOREIGN PATENT DOCUMENTS

| | | | |
|---|---|---|---|
| EP | 0 049 718 | A1 | 10/1980 |
| EP | 0 626 927 | B1 | 2/1993 |
| EP | 1 306 337 | B1 | 10/2002 |
| EP | 2 374 745 | A2 | 10/2011 |
| FR | 2824547 | A1 | 11/2002 |
| JP | 8-259080 | A | 10/1996 |
| JP | 1876122 | A1 | 1/2008 |
| WO | 2004/018338 | A1 | 3/2004 |
| WO | 2011/117509 | A1 | 9/2011 |

OTHER PUBLICATIONS

European Search Report for EP 11 30 6769 dated May 11, 2012.

* cited by examiner

*Primary Examiner* — Douglas Hess
(74) *Attorney, Agent, or Firm* — Sughrue Mion, PLLC

(57) ABSTRACT

A system for improving stacking of flat items stacked on edge and forming a batch of items in a sort bin (200*a*) of the type comprising a stacking deck (210) for supporting the batch of items, a paddle (220) movably connected to a shaft (224) mounted on the stacking deck for registering the batch of items while applying a first stacking pressure to the batch of items, a driving device (228) for applying at least another adjustable pressure to the batch of items for refining their registering against the paddle, and a movement control module (229) for controlling the driving device so as to adjust pressure in the batch of items, wherein the batch of items and the paddle are driven synchronously and separately.

8 Claims, 3 Drawing Sheets

SYSTEM FOR IMPROVING STACKING OF FLAT ITEMS

FIELD OF THE INVENTION

The present invention generally relates to a mail piece or document stacking system and, more particularly, to an on-edge stack support in a stacking bin of a high speed sorting machine for moving this mail piece or document towards a paddle while providing a resisting force to the batch as the mail piece or document is accumulated into this latter.

PRIOR ART

Flat item processing systems, such as mail piece processing, sorting and bar code application systems, typically include an item stacking apparatus at the end of the system for securing the sorted mail pieces in a stacked position to facilitate orderly removal of the processed mail pieces from the system. The stacked mail pieces are manually or automatically removed from the batch by an operator. US2002/017447, WO2011/117509, WO2004/018338, EPO49718, U.S. Pat. No. 5,524,876, EP1876122 and the following are part of prior art documents.

EP 0 626 927 discloses a stacker assembly for receiving generally flat documents, such as mailing envelopes and flats, in on-edge relation and maintaining the documents in upstanding side-by-side stacked relation as they accumulate in the stacker assembly. A receiving station is supported at one end of a horizontal support plate and guides successive incoming documents into stacked relation transverse to the longitudinal axis of the stacker assembly. A stacker plate is supported to engage the forwardmost document in the stack and is movable longitudinally on the stacker assembly in response to accumulation of documents in the stacker. Means in the form of a reversing spring and a wedge plate cooperate with the stacker plate in a manner to apply a variable pressure against the documents so as to accommodate both thin lightweight and heavier documents in the stack while maintaining them in upstanding relation.

EP 1 306 337 discloses an adjustable urging force system for a stacker paddle. As disclosed in this patent application, a paddle urging system for use in a stacking bin presents a constant force spring to provide an urging force to a paddle for supporting a stack of mail pieces. As mail pieces are accumulated into the stack, they push the stack against the paddle. A brake/clutch system is used to provide an additional drag to the paddle to resist against this movement of this paddle. The brake/clutch system is adjustable so that heavy mail pieces are supported more effectively, whereas lightweight mail pieces encounter less resistant force when they are accumulated into the stack.

U.S. Pat. No. 6,959,923 relates to a method and device for stacking a plurality of vertically oriented mail pieces into a stack, wherein mail pieces are sequentially received into the back end of the stack. A paddle is used to support the front end of the stack in order to prevent the top mail pieces from falling forward. A conveyor belt is used to move the mail pieces in the stack and relieve the pack pressure so as to allow new mail pieces to join the stack. Information indicative of the mail piece thickness is provided to a movement control module so that the conveyor belt is moved according to the thickness of the mail pieces received into the stack. As such, the pressure in the stack can be properly adjusted. The thickness information can be obtained from an upstream collator, for example.

US 2009.242464 discloses a mail feeder auxiliary paddle within a mail sorter including a conveying surface and a main paddle movably disposed on a slide member for supporting a first end of a main stack of mail pieces while traversing along the conveying surface to apply a first stacking pressure to the mail pieces. An auxiliary paddle is also disposed on the slide member for segregating an auxiliary stack of mail pieces from the main stack of mail pieces. The auxiliary paddle is moveable between a first position where the auxiliary paddle is free of contact with any of the mail pieces and a second position where the auxiliary paddle supports the auxiliary stack of mail pieces against the main paddle to apply a second stacking pressure to the auxiliary stack of mail pieces, the second stacking pressure being less than the first stacking pressure.

While the stacking systems including resisting force providing devices of the prior art often prove satisfactory, they also prove rather complex with a precise adjustment of the stacking pressure and a stack pressure sensing subject to errors.

OBJECT AND SUMMARY OF THE INVENTION

To overcome these disadvantages, the present invention proposes a simpler stacking system with an optimal stacking pressure mechanism. More particularly, an object of the present invention is thus to provide a high speed stacking system that doesn't need to accurately sense the stack pressure of flat items for substantially reducing the occurrence of item jamming.

According to the invention, a system for improving stacking of flat items stacked on edge and forming a batch of items in a sort bin of the type comprising:

- a stacking deck for supporting the batch of items;
- a paddle movably connected to a shaft mounted on the stacking deck for registering said batch of items while applying a first stacking pressure to said batch of items;
- a driving device for applying at least another adjustable pressure to said batch of items for refining their registering against the paddle; and
- a movement control module for controlling the driving device so as to adjust pressure in the batch of items, characterized in that the batch of items and the paddle are driven synchronously and separately.

The provision of at least two pressures allows replacing a precise stacking pressure adjustment prone to erroneous stack pressure sensing.

Advantageously, each component of said driving device comprises at least a first and a second set of endless belts which are drivingly mounted around upstream and downstream pulleys carried respectively by common upstream and downstream shafts.

Preferably, said first set of endless belts comprises two outer series of round belts and said second set of endless belts comprises at least one inner timing toothed belt, the round belts running around outer pulleys the diameters of which are greater than those of the inner pulleys around which the at least inner toothed belt is mounted.

Advantageously, the flat items rest on the outer round belts and are accumulated into the batch of items against the paddle, said paddle having at least a lug that is received in the notch formed between two teeth of the at least one inner timing toothed belt for cooperating with said shaft so as to provide the first stacking pressure to said batch of items.

Preferably, one of the inner pulleys are rigidly fixed, e.g. screwed, to a driving shaft while the corresponding outer pulleys are driven by this latter via a one-way bearing, the other driven inner and outer pulleys being rotatably mounted on the other shaft.

Advantageously, the dimensional difference between the respective diameters of the outer and inner pulleys for provides a first soft straightening up of the flat items.

Preferably, said movement control module is adapted to move the at least one inner timing belt backwards or upwards at intervals while maintaining the two outer series of round belts stationary and steady thanks to the one-way bearings that become free in rotation, for providing a second firm straightening up of the flat items.

BRIEF DESCRIPTION OF THE DRAWINGS

The present invention will become apparent upon reading the following more specific description of a preferred embodiment as illustrated in the accompanying figures in which.

DETAILLED DESCRIPTION OF EMBODIMENTS

Figure 1:
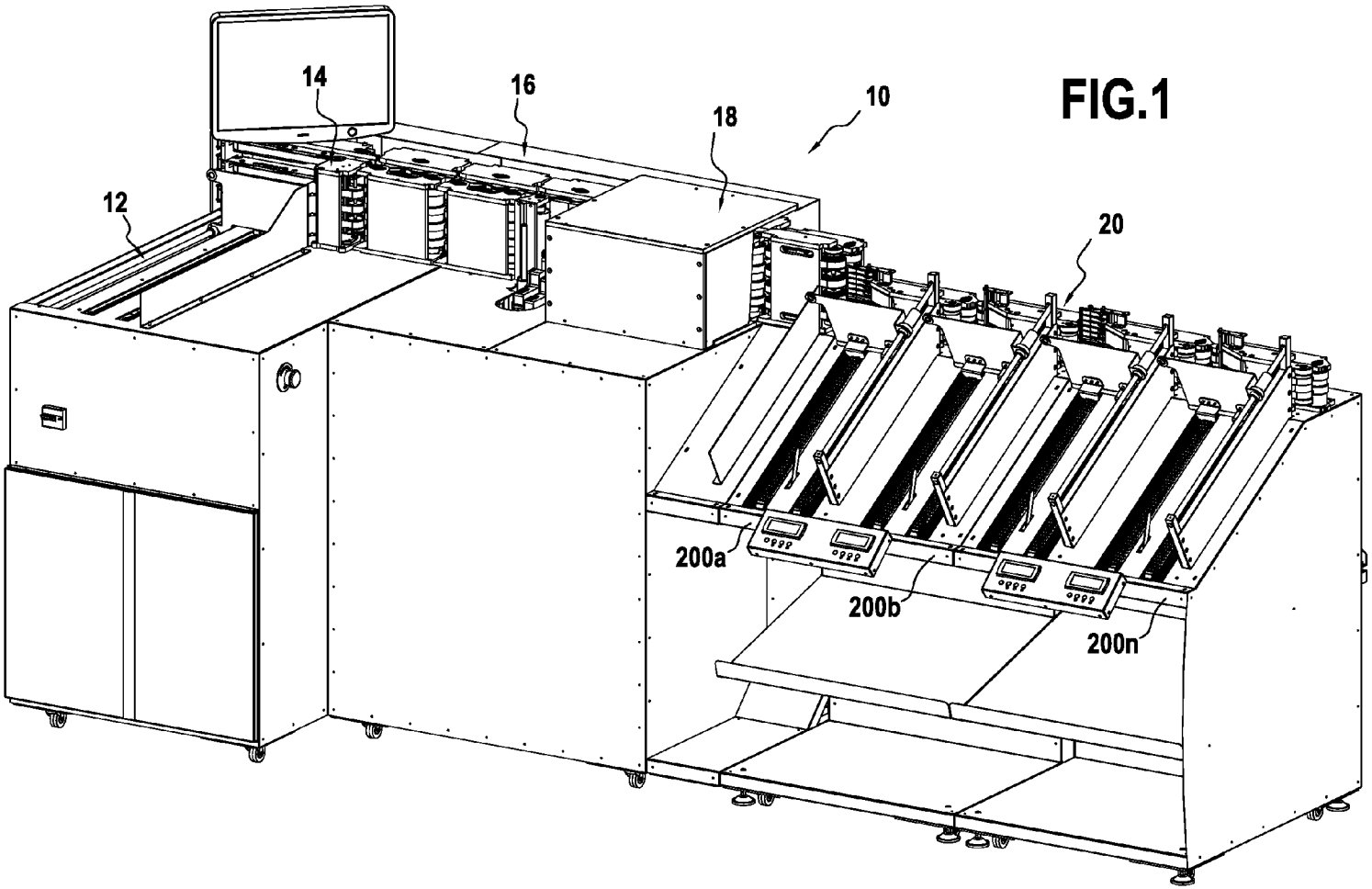
FIG. 1 is a perspective view of a mail sorting machine incorporating the stacking system of the present invention.

As shown in FIG. 1, a mail sorting machine designated by reference numeral 10 generally comprises the following main components:

- a delivering section 12 that receives flat items such as mail pieces like stuffed envelopes to be sorted;
- a singulating section 14 at which the individual items are separated one at a time from the stack or batch of envelopes loaded on the delivering section;
- a printing section 16 at which some sorting code or information is printed on each envelope;
- a scanning section 18 at which the zip code and/or other sorting information imprinted on each envelope is scanned; and
- a sorting section 20 towards which the envelopes are transported, diverted, guided and stored in designated sort bins;

the control of the mail sorting machine being processed by a transport and imaging computer (not shown) disposed in one or shared by each of these sections.

Figure 2:
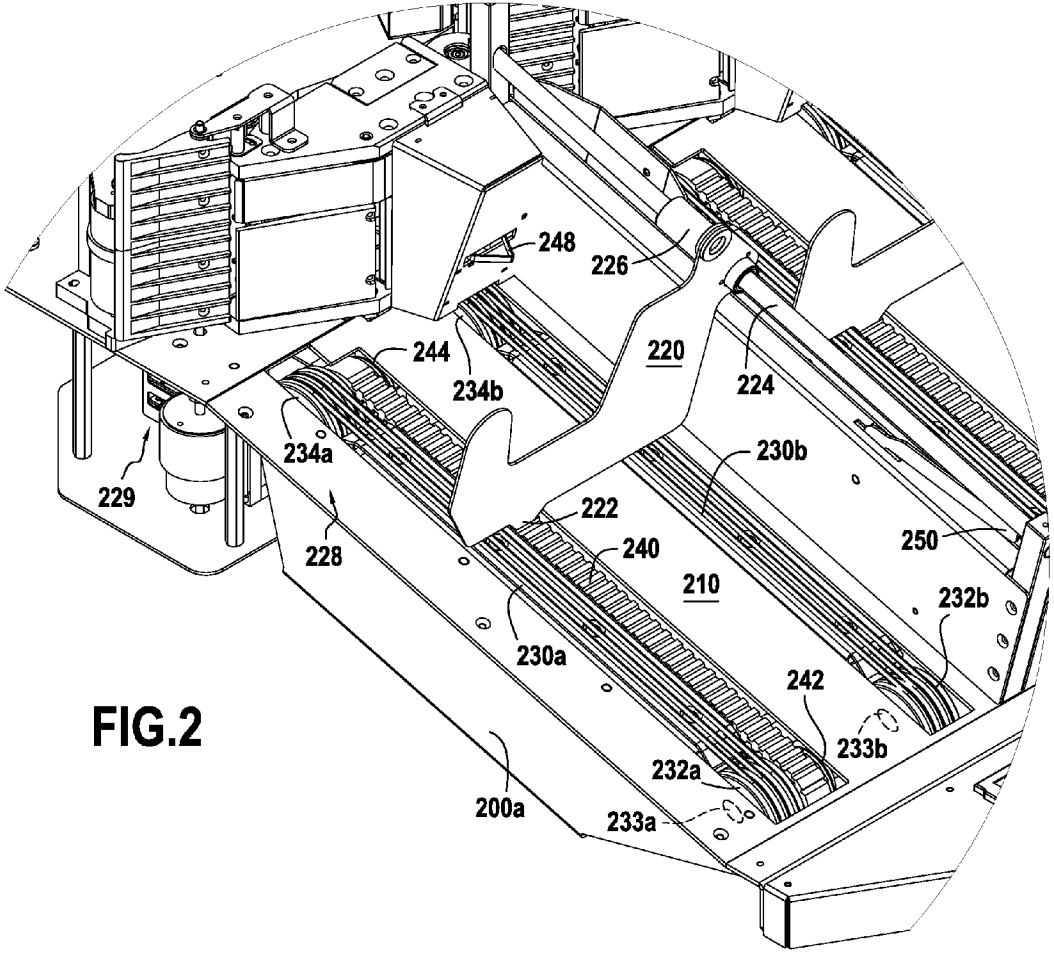
FIG. 2 is enlarged perspective view of the stacking system included in the mail sorting machine of FIG. 1.
Figure 3:
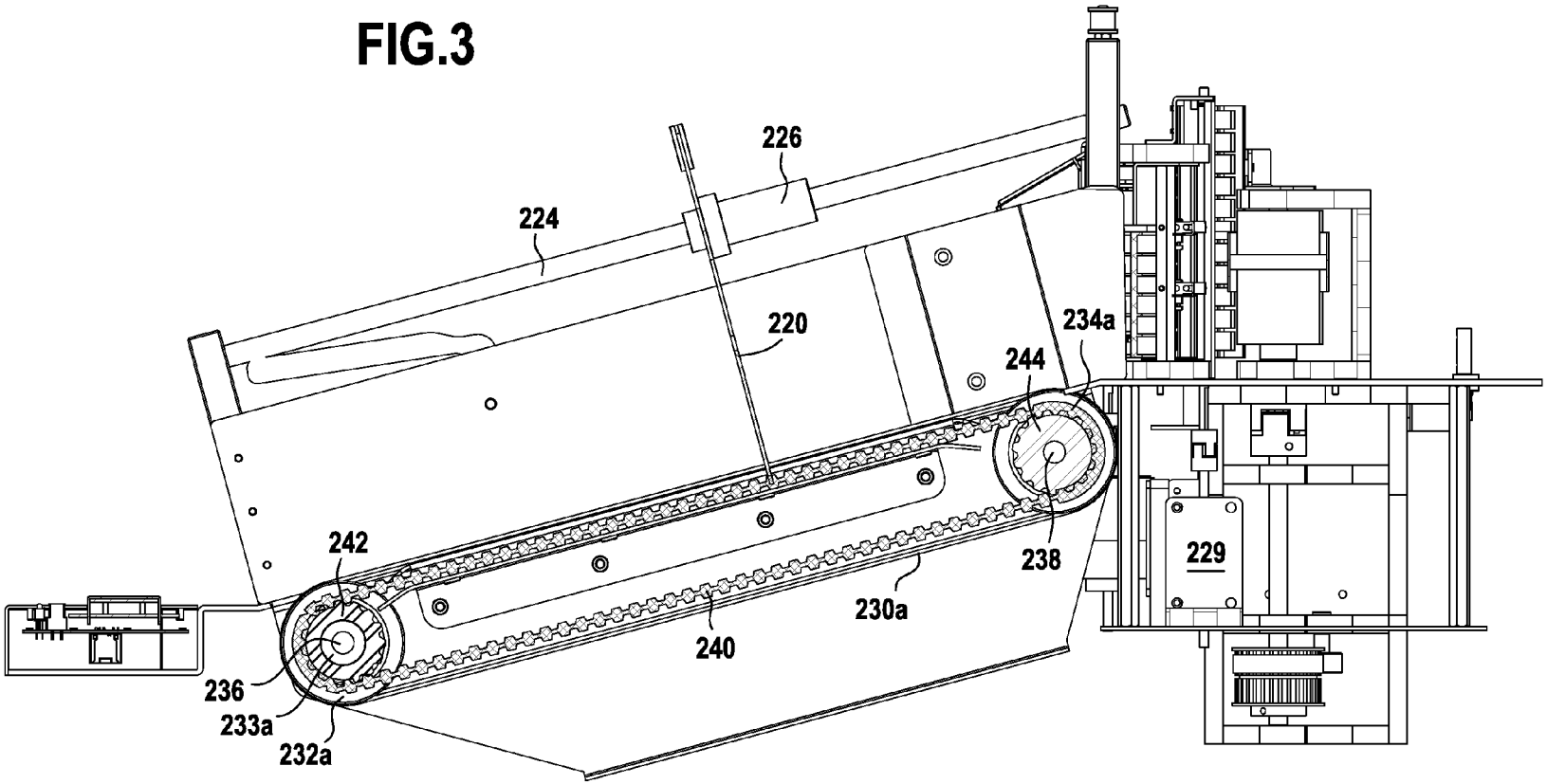
FIG. 3 is side elevation view of the stacking system of FIG. 2.

FIGS. 2 and 3 illustrate in more detail an elementary sort bin 200*a*, 200*b* . . . 200*n* of the sorting section 20. Each sort bin presents a stacking deck 210 with an upstream end and a downstream end for supporting the batch of items, a paddle 220 movably connected to a shaft 224 mounted on the stacking deck via a sleeve 226 for registering the first end of the batch while applying a first stacking pressure to said batch of items, a driving device 228 for applying at least another adjustable pressure to said batch of items for refining their registering against this paddle, and a movement control module 229 for controlling the driving device so as to adjust pressure in the batch.

The driving device 228 comprises two different components which synchronously and separately drive the respective batch of items and paddle 220. It comprises two sets of endless belts 230, 240 which are drivingly mounted around upstream and downstream pulleys 232*a*, 232*b*, 234*a*, 234*b*; 242, 244 carried respectively by common upstream and downstream shafts 236, 238. In the illustrated embodiment, this first set of endless belts comprises two outer series of round belts 230*a*, 230*b* and said second set of endless belts only comprises one inner timing toothed belt 240, the round belts running around outer pulleys 232*a*, 232*b*, 234*a*, 234*b* the diameters of which are greater than those of the inner pulleys 242, 244 around which the inner toothed belt 240 is mounted. This configuration is however not limitative and a second set of endless belts comprising two inner timing toothed belts is also possible as illustrated in FIG. 1.

The flat items rest on the outer round belts 230*a*, 230*b* and are accumulated into the batch which is supported by the paddle 220, said paddle having a lug 222 that is received in the notch formed between two teeth of each inner timing toothed belt 240 for cooperating with the shaft 224 and the sleeve 226 so as to provide the first stacking pressure to said flat items. The downstream inner pulley 242 is rigidly fixed, e.g. screwed, to the downstream driving (motorized) shaft 236 while the downstream outer pulleys are driven by this latter via a one-way bearing or clutch 233*a*, 233*b*, the upstream driven inner and outer pulleys 234*a*, 234*b*, 244 being rotatably mounted on the upstream shaft 238.

The output module or sort bin 200*a*, 200*b* . . . 200*n* described above operates as follows. In order to improve the collection and the stacking of envelopes in each sort bin, a simple adjustable means for providing complementary resisting forces to a batch of envelopes as these latter are accumulated into the batch, is proposed.

When the on-edge envelopes enter the sort bin on the stacking deck 210, they are detected by a first sensor 248 for moving the paddle 220 downstream, and are directed at once to the outer belts 230*a*, 230*b* which drive them towards the paddle 220. They then tend to lean forward as their low parts tend to hold back. To reduce this known phenomenon, the tilt angle of the stacking deck 210 is first limited to a value of less than 30 degrees, preferably around 15 degrees. Then, the driving device 228 has been designed specifically for further straightening up the batch of envelopes and also adjusting the stacking pressure within the batch.

While the batch thickness increases, the paddle 220 goes down under the stacking pressure of the accumulating envelopes and the outer series of round belts 230*a*, 230*b* and the inner timing toothed belt 240 rotate together at a different speed. Due to the different diameters of inner 242, 244 and outer pulleys 232*a*, 232*b*, 234*a*, 234*b*, the higher speed of the outer round belts allows pushing the low parts of the envelopes towards the paddle 220; a first soft continuous straightening up of the envelopes is then obtained. As an example, the speed of the outer round belts is about 42% greater than the speed of the inner toothed belts when their pulley diameters are 67 mm and 47.7 mm respectively. First sensor 248 not only detects the arrival of the envelopes, but also the uppermost position of the paddle as minimal space is required for allowing the incoming envelopes to enter.

The arrangement mentioned above for additionally adjusting pressure in the batch of envelopes further includes programming the movement control module (not shown) in order to move the inner timing belt 240 backwards or upwards at intervals while maintaining the two outer series of round belts 230*a*, 230*b* stationary and steady thanks to the one-way bearings or clutches 233*a*, 233*b* that become free in rotation, for providing a second firm cyclic straightening up of the flat items. The movement control module drives the inner timing belt 240 back up in accordance with the sensed number of items in the batch or the determined thickness of the batch, e.g. every 10 items. This temporized or cyclic impulse brings about a quick more significant correction of the vertical position of the batch.

The two outer series of round belts 230*a*, 230*b* are rendered sufficiently coarse with a slight friction factor in order to avoid slippage of the envelopes during the combined adjustment of the stacking pressure. Even when there are a few envelopes stacked, the six outer round belts and these envelopes remain thus steady. Second sensor 250 detects the final position to come of the growing batch corresponding to the full state of the stacking bin. The movement control module then stops the driving device for the operator to unload the stacking bin.

The invention claimed is:

1. A system for improving stacking of flat items stacked on edge and forming a batch of items in a sort bin (200*a*, 200*b* . . . 200*n*), comprising:

a stacking deck (210) for supporting the batch of items;

at least a first and a second set of endless belts (230, 240) which are drivingly mounted around upstream and downstream pulleys (232, 234, 242, 244) carried respectively by common upstream and downstream shafts (236, 238), said first set of endless belts comprises two outer series of round belts (230*a*, 230*b*) on which the flat items rest and said second set of endless belts comprises at least two belts, at least one of the two belts including an inner timing toothed belt (240), the round belts running around outer pulleys (232*a*, 232*b*, 234*a*, 234*b*) the diameters of which are greater than those of the inner pulleys (242, 244) around which the at least one inner timing toothed belt is mounted;

a paddle (220) movably connected to a shaft (224) mounted on the stacking deck for registering the flat items accumulated into said batch of items, said paddle having at least a lug (222) that is received in a notch formed between two teeth of the at least one inner timing toothed belt for cooperating with said shaft so as to apply a first stacking pressure to said batch of items;

a driving device (228) for applying at least another adjustable pressure to said batch of items for refining their registering against the paddle; and a movement control module (229) for controlling the driving device so as to adjust pressure in the batch of items, the batch of items and the paddle being driven synchronously and separately;

wherein one (242) of the inner pulleys is rigidly fixed to a driving shaft (236) while the corresponding outer pulleys (232*a*, 232*b*) are driven by the driving via a one-way bearing (233*a*, 233*b*), the other driven inner and outer pulleys (234; 244*a*, 244*b*) being rotatably mounted on the other shaft (238).

2. The system of claim 1, wherein the dimensional difference between the respective diameters of the outer (232*a*, 232*b*, 234*a*, 234*b*) and inner pulleys (242, 244) provides a first soft straightening up of the flat items.

3. The system of claim 2, wherein said movement control module is adapted to move the at least one inner timing toothed belt (240) backwards or upwards at intervals while maintaining the two outer series of round belts (230*a*, 230*b*) stationary and steady thanks to the one-way bearings that become free in rotation, for providing a second firm straightening up of the flat items.

4. The system of claim 3, wherein said movement control module drives the at least one inner timing toothed belt (240) back up in accordance with the number of flat items in the batch of items or the thickness of the batch of items.

5. The system of claim 1, wherein the two outer series of round belts (230*a*, 230*b*) are sufficiently coarse with a slight friction factor in order to avoid slippage of the flat items during adjustment of the stacking pressure.

6. The system of claim 1, wherein the sort bin (200*a*, 200*b* . . . 200*n*) is tilted down at an angle which is smaller than 30 degrees so as to cooperate in the adjustment of the stacking pressure.

7. The system of any one of claims 1, wherein said flat items are mail pieces such as stuffed envelopes which are processed in a sorting machine.

8. The system of claim 1, wherein the sort bin (200*a*, 200*b* . . . 200*n*) is tilted down at an angle which is smaller than 15 degrees.

* * * * *